US005836787A

United States Patent [19]

Kodama

[11] Patent Number: 5,836,787

[45] Date of Patent: Nov. 17, 1998

[54] CONNECTOR ASSEMBLY WITH CONNECTOR HOUSING RETAINING STRUCTURE

[75] Inventor: Shinji Kodama, Haibara-gun, Japan

[73] Assignee: Yazaki Corporation, Tokyo, Japan

[21] Appl. No.: 842,570

[22] Filed: Apr. 15, 1997

[30] Foreign Application Priority Data

Apr. 17, 1996 [JP] Japan ..... 8-95146

[51] Int. Cl.[6] ..... H01R 13/60

[52] U.S. Cl. ..... 439/567; 439/364

[58] Field of Search ..... 439/567, 555, 439/557, 552, 364

[56] References Cited

U.S. PATENT DOCUMENTS

| | | | |
|---|---|---|---|
| 4,957,449 | 9/1990 | Hatagishi | 439/364 |
| 5,000,693 | 3/1991 | Hatagishi et al. | 439/248 |
| 5,711,630 | 1/1998 | Kodama | 403/329 |

FOREIGN PATENT DOCUMENTS

| | | |
|---|---|---|
| 1-17827 | 5/1989 | Japan . |
| 2-285906 | 11/1990 | Japan . |
| 5-61908 | 8/1993 | Japan . |

*Primary Examiner*—P. Austin Bradley
*Assistant Examiner*—T. C. Patel
*Attorney, Agent, or Firm*—Armstrong, Westerman, Hattori, McLeland & Naughton

[57] ABSTRACT

A first connector housing can be attached to an electrical instrument, and a second connector housing can be disposed on a part of a panel wall. The first and second connector housings are connected together by a screw-joining means including a bolt and a nut. The second connector housing can be provisionally retained on the panel wall by a provisionally retaining means. When the connectors connect together, the second connector housing can part from the panel wall toward the first connector housing; when the connectors separate from each other, the second connector housing can be provisionally retained on the panel wall by the provisionally retaining means.

7 Claims, 5 Drawing Sheets

CONNECTOR ASSEMBLY WITH CONNECTOR HOUSING RETAINING STRUCTURE

BACKGROUND OF THE INVENTION

1. Field of the Invention

This invention relates to a connector assembly with a connector housing retaining structure including a first connector housing and an opposing second connector housing for an electrical instrument. The first connector housing is detachably retained by a panel wall and is securely connected to the second connector housing by a screw-jointing means with a bolt and a nut. Further, the electrical instrument can be easily dismounted even with the presence of the connector assembly.

2. Description of the Prior Art

FIG. 8 shows a conventional connector assembly with a connector housing retaining structure disclosed in Japanese Utility Model Laid-open No. 1-17827.

In the assembly, a connector retainer 53 having a resilient supporting arm 52 for a male connector 51 is secured to an instrument panel wall 54 of an automobile vehicle by clipping members 55. Further, the male connector 51 slidably supported by the supporting arm 52 is coupled to a female connector 57 fitted to a meter assembly or an electrical instrument 56.

The male connector 51 has a collar plate 58 fitted in the middle of the connector housing. The collar plate 58 abuts against the fore end of an arm supporting wall 59; the free end of the supporting arm 52 opposes to a locking projection 60 formed in the rear end portion of the housing. Thence, the male connector housing is supported in the engagement direction by a plurality of the opposing arms 52 but is allowed to slightly deviate perpendicularly to the engagement direction (or laterally). Accordingly, the meter assembly 56 is secured to the panel wall 54 so that the connectors 5D and 57 can couple securely together even if the male and female connectors 51 and 57 have not initially axially aligned. That is, the arm 52 allows the lateral shift between both the connectors. The meter assembly 56 is secured to the panel wall 54 by bolts (not shown).

However, in the aforementioned conventional assembly, a broader spacing L between the panel wall 54 and the meter assembly 56 may cause incomplete engagement of the connectors 51 and 57. Moreover, there is another drawback that the meter assembly 56 is not easily dismounted from the panel wall 54 because of the male and female connectors 51 and 57 having connected together.

SUMMARY OF THE INVENTION

In view of the drawbacks, an abject of this invention is to provide a connector assembly with a connector housing retaining structure, in which the complete connector engagement is positively enabled even for a broader spacing between a panel wall and a meter assembly. Further, the meter assembly can be easily dismounted from the panel wall regardless of the presence of the engaged connectors.

For achieving the object according to this invention, a connector assembly with a connector housing retaining structure includes basically a first connector housing to be attached to an electrical instrument, and a second connector housing to be disposed toward a panel wall, wherein the first and second connector housings are connected together by a screw-joining means including a bolt and a nut;

the second connector housing can be provisionally retained on the panel wall by a provisionally retaining means;

when the connectors connect together, the second connector housing can be released from the panel wall toward the first connector housing; and, when the connectors separate from each other, the second connector housing can be provisionally retained on the panel wall by way of the provisionally retaining means.

The provisionally retaining means may include a resilient retaining arm provided in the second connector housing and engaging with an opening formed in the panel wall.

Alternatively, the provisionally retaining means nay include a deflectable retaining arm projecting from the panel wall and a provisionally engaging portion formed in the second connector housing so as to engage with the deflectable retaining arm.

Besides, the first connector housing has advantageously a preliminary engaging portion; the second connector housing has a preliminary retaining portion engaging with the preliminary engaging portion; and the stopping force between the preliminary engaging portion and the preliminary retaining portion is smaller than the engaging force between the provisionally retaining means and the panel wall.

DETAILED DESCRIPTION OF THE PREFERRED EMBODIMENTS

Embodiments of the invention will be discussed in derail hereinafter as referring to the accompanied drawings.

Figure 1:
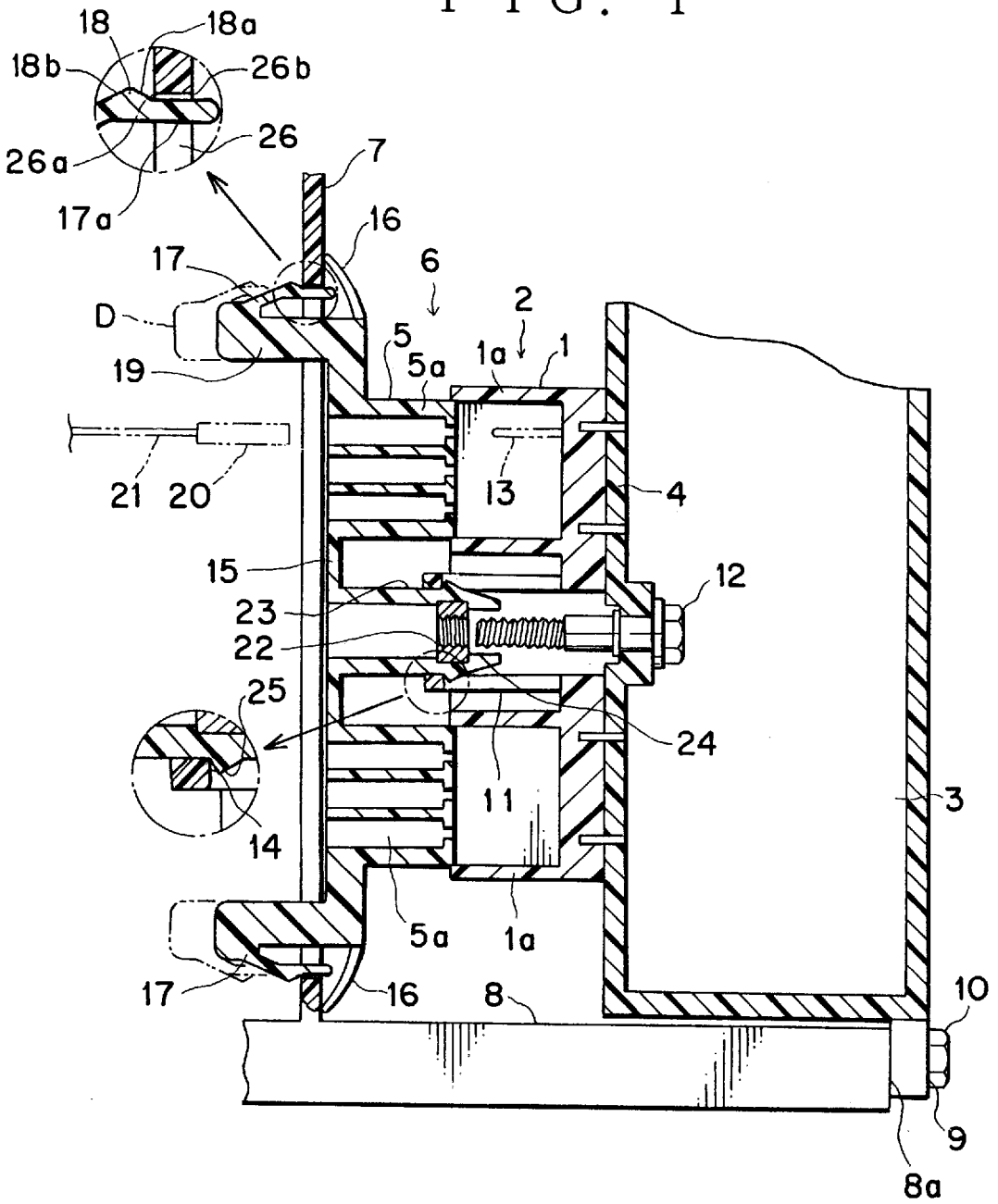
FIG. 1 is a longitudinal sectional view of a first embodiment of the connector assembly with a connector housing retaining structure according to the invention, in which the connectors have been disconnected.
Figure 3:
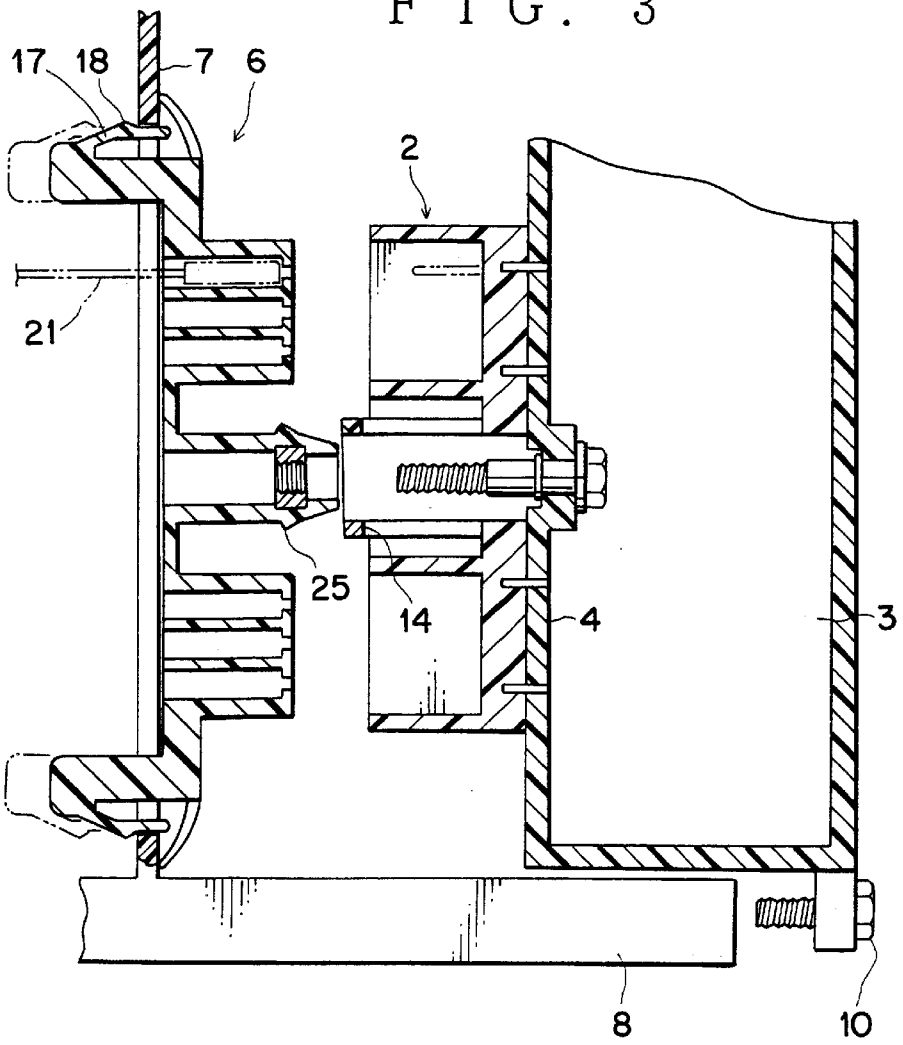
FIG. 3 is also a longitudinal sectional view of the first embodiment, in which an electrical instrument have been dismounted.
Figure 2:
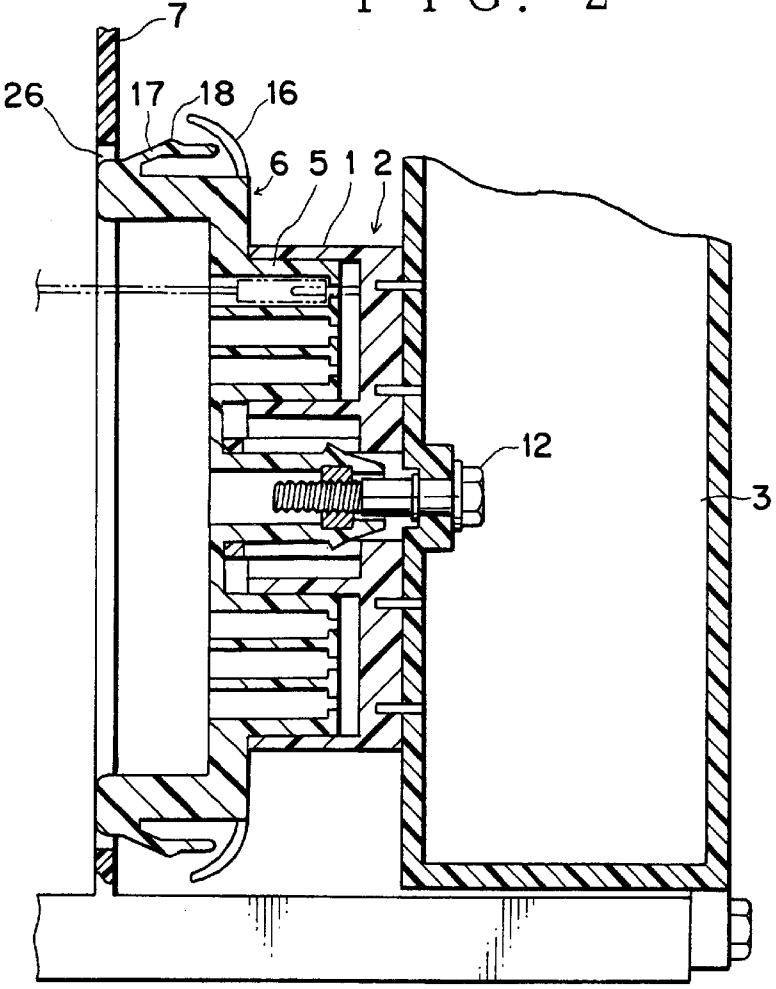
FIG. 2 is also a longitudinal sectional view of the first embodiment, in which the connectors have connected.

FIGS. 1 to 3 show a first embodiment of a connector with a connector housing retaining structure according to the invention. The combined assembly, as shown in FIG. 1, has a first connector housing 2 with female connectors 1; the first connector housing 2 is fixed to a base plate 4 of a meter assembly 3 (or an instrument). The combined assembly further has a second connector housing 6 with male connectors 5; the second connector housing 6 is disposed so as to be provisionally retained by an instrument panel wall 7. The second connector housing 6, as shown in FIG. 2 can be released from the panel wall 7 together with the engaged first connector housing 2.

The panel wall, 7 rises from a wall frame 8 extending toward the meter assembly 3; a bracket 9 of the meter assembly 3 is secured to an end 8*a* of the wall frame 8 by bolts 10. The first connector housing 2 integrally molded of a synthetic resin has a plurality of female connector bodies 1*a* (a symmetrical couple of ones in this embodiment). The connector housing 2 further has a cylindrical wall 11 in the middle thereof; the cylindrical wall 11 has a bolt 12 mounted inside the wall 11. The turnable bolt 12 is supported by the base plate 4 of the meter assembly 3. In the female connector body 1*a* are mounted a plurality of male terminals 13 to compose the female connector 1. Moreover, the cylindrical wall 11 has a preliminarily engaging cut-out portion 14 for the second connector housing 6.

The second connector housing 6 has a couple of male connector bodies 5*a* molded of a synthetic resin integrally with a frame 15. The frame 15 has a pair of resilient arms 16 extending outwardly from an outer periphery of the frame and a pair of resilient retaining arms 17 (a provisionally retaining means). The frame 15 is resiliently attached to the panel wall 7 by way of the resilient arms 16, 17. The resilient retaining arm 17 is formed integrally with a supporting strut 19 extending backwardly from the frame 15 and has a substantially triangular, positioning protrusion 18 (a provisionally stopping protrusion) in the middle of the arm. The positioning protrusion 18 abuts against the panel wall 7 to provisionally position the second connector housing 6. The assignee of this application has disclosed the construction or more details of the resilient arms 16, 17, which allow some deviation of the frame, in Japanese Patent Application No. 8-22491. The second connector housing 6 can move within a free end guide portion 17*a* of the resilient retaining arm 17 as illustrated by a dotted line D.

The male connector body 5*a* receives and keeps female terminals 20 to compose a male connector 5. A plurality of electrical wires 21 connected to the Female terminals 20 are bundled to compose a wiring harness. Further, in the middle or the frame 15 is formed with an axially extending, supporting cylinder 23 provided with a nut 22. The nut 22 can screw-joint with the bolt 12. The supporting cylinder 23 has a tapered end, guide portion 24. On an outer surface of the guide portion 24 is formed with a preliminary stopping protrusion 25 (a preliminary retaining portion) abutting against the preliminary engaging portion 14. The stopping force between the preliminary stopping protrusion 25 and the preliminary engaging portion 14 is determined to be smaller than the engaging force between the positioning protrusion 18 of the resilient retaining arm 17 and the panel wall 7. In other words, the engaging force of the positioning protrusion 18 with the panel wall 7 is larger than the stopping force between the preliminary stopping protrusion 25 and the preliminary engaging portion 14.

As shown in FIG. 2, screw-jointing the bolt 12 to the nut 22 releases the second connector housing 6 from the panel wall 7 to move the housing 6 toward the first connector housing 2, which accomplishes the engagement to the male and female 7 connectors 5 and 1. That is, one tapered face 18*a* (FIG. 1) of the provisionally stopping protrusion 18 slidably contacts with a peripheral face 26*a* of the panel wall opening 26; this forces the resilient retaining arm 17 to deflect inwardly so that the provisionally stopping protrusion 18 rides over and parts from the panel wall 7 toward the first connector housing 2. Accordingly, both the resilient arms 16, 17 have been released from the panel wall 7. Further, the nut supporting cylinder 23 has advanced into the cylindrical wall 11.

Hence, the first connector housing 2 can have a connector engagement stroke allowing a relatively free initial position of the panel wall 7 to the first housing. That is, the connector housings can engage together even if the panel wall initially has been deviated a little from a designed position. Further, the second connector housing 6 itself and its resilient arms 16, 17, which tend to generate vibration, can be released completely from the panel wall 7. This eliminates the drawback that the resilient arms 16, 17 vibrate as hitting the panel wall 7 to generate a noise during the vehicle running.

Meanwhile, reversely turning the bolt 12 to release the connector 5 from the connector engagement state shown in FIG. 2 causes the other tapered face 18*b* (FIG. 1) of the provisionally stopping protrusion 18 of the resilient retaining arm 17 to slidably come in contact with an end surface 26*b* of the panel wall opening 26. Then, the resilient retaining arm 17 deflects inwardly so that the provisionally stopping protrusion 18 rides over the panel wall 7 to provisionally engage with the panel wall opening 26 as shown in FIG. 1.

Further, in the detachment of the meter assembly 3 from the connector disengaged state shown in FIG. 1, as shown in FIG. 3, reversely turning the bolt 10 releases the meter assembly 3 from the frame 8. Then, the meter assembly 3 with the connector housing 2 is drawn out toward the dismounting direction by hand or by using a drawing-out stroke of the bolt 10. This disengages the preliminary stopping protrusion 25 from the preliminary engaging portion 14 so that the first connector housing 2 and the meter assembly 3 can be unitedly dismounted. To achieve this, as described above, the stopping force between the preliminary stopping protrusion 25 and the preliminary engaging portion 14 is necessarily smaller than the engaging force of the panel wall 7 with the positioning protrusion 18 of the resilient retaining arm 17.

Hence, the meter assembly 3 can easily be released from the second connector housing 6 and the panel wall 7. In the dismounting of the meter assembly 3, the second connector housing 6 receives no tensile force, which eliminates a drawback such as damage in the wiring harness (the electrical wires 21).

Besides, the meter assembly 3 may be replaced by a part of an audio system or the like; the base plate portion 4 of the meter assembly 3 may be replaced by an instrument panel wall and further the panel wall 7 by a body panel wall of the vehicle.

Figure 4:
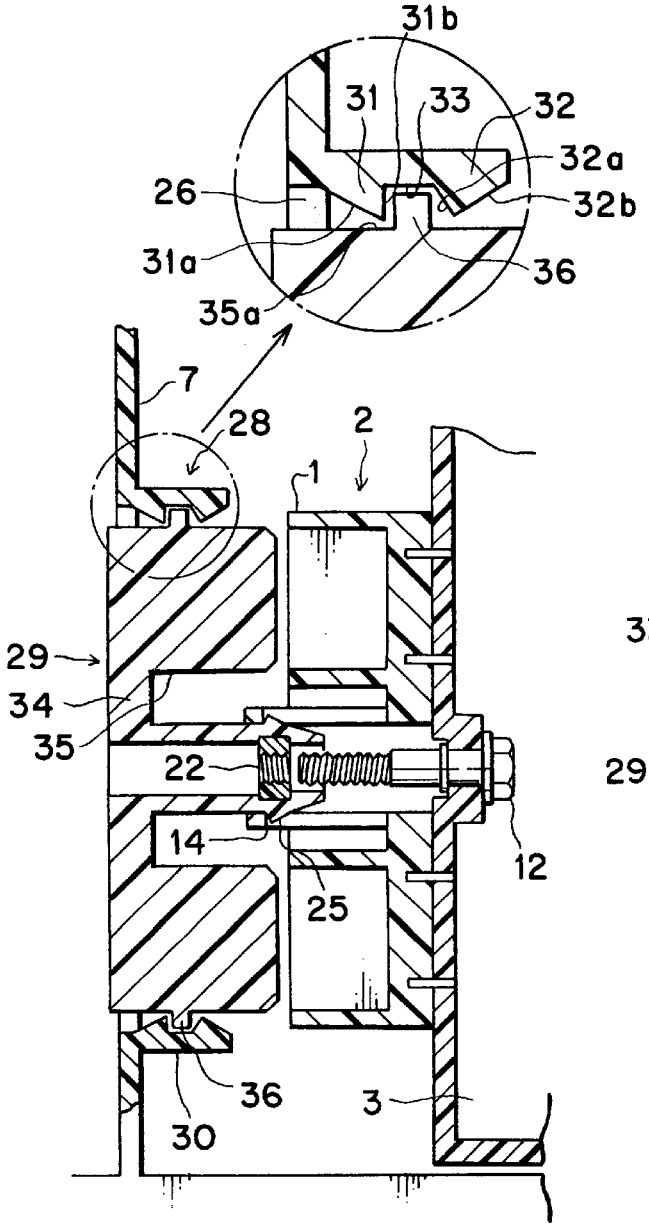
FIG. 4 is a longitudinal sectional view of a second embodiment of a connector assembly with a connector housing retaining structure according to the invention, in which the connectors have been disconnected.
Figure 5:
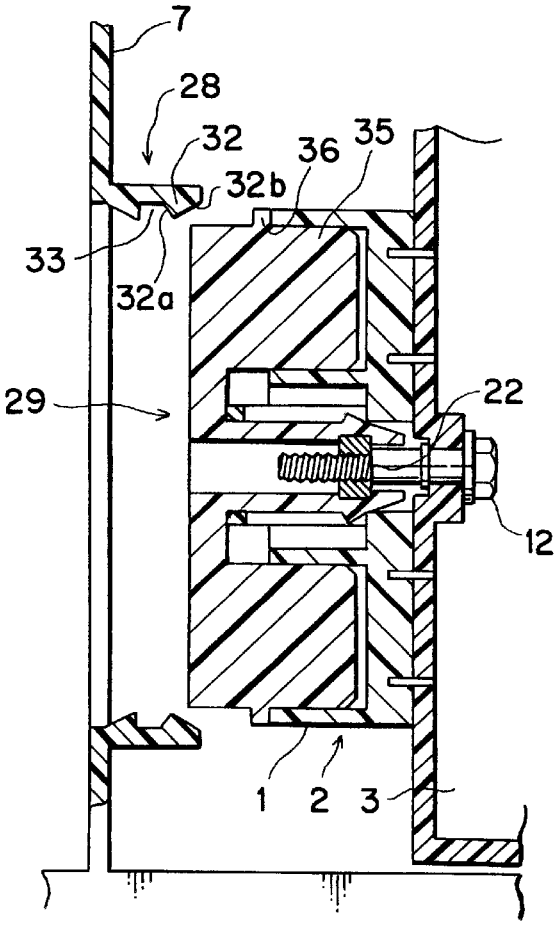
FIG. 5 is also a longitudinal sectional view of the second embodiment,in which the connectors have connected.

FIGS. 4 and 5 show a second embodiment of a connector assembly with a connector housing retaining structure according to the invention.

In this structure, the panel wall 7 is formed with a provisionally retaining portion 28 being able to retain a second connector housing 29. The provisionally retaining portion 28 includes a pair of left and right deflectable engaging arms rising from a periphery of a panel opening 26. The deflectable engaging arm 28 has a provisionally engaging groove 33 between a couple of projecting portion 31, 32 aligned in the connector engaging direction. The projecting portion 31 located near the panel wall 7 has a tapered face 31*a* and a vertical abutting face 31*b*. The other projecting portion 32b more apart from the panel wall 7 has tapered faces 32*a*, 32*b* respectively at each side thereof.

The second connector housing 29 has a frame 34 with an integrally molded male connector body 35. On an outer surface 35*a* of the male connector body there is formed with a substantially rectangular, provisionally engaging projection 36 engaging with the provisionally engaging groove 33. Just as the first embodiment, the stopping force between the preliminary engaging portion 14 of the first connector housing 2 and the preliminary stopping protrusion 25 of the second connector housing 29 is designed to be smaller than the engaging force between the provisionally engaging projection 36 and the deflectable arm 28. Descriptions of the other structures the same as the first embodiment will be omitted.

As shown in FIG. 4, the provisionally engaging projection 36 engages with the provisionally engaging groove 33 and abuts against the abutting face 31*b*. This holds provisionally the second connector housing 29 on the panel wall 7 without the housing falling-out from the wall. In this state, the first connector housing 2 having female connectors 1 and attached to the meter assembly 3 has disconnected from and opposed to the second connector housing 29. As shown in FIG. 5, screw-jointing the bolt 12 to the nut 22 makes the second connector housing 29 apart from the deflectable engaging arm 28. This also moves the second connector housing 29 toward the first connector housing 2 so that the connectors 1, 35 engage together. That is, the deflectable engaging arm 28 deflects outwardly so that the provisionally engaging projection 36 is released from the groove 33 along a tapered face 32*a* of the fore end projecting portion 32 to move toward the first connector housing 2.

In the state shown in FIG. 5, reversely turning the bolt 12 moves the second connector housing 29 toward the panel wall 7. Thereby, the provisionally engaging projection 36 advances along a tapered face 32*b* of the deflectable engaging arm 28 and into the groove 33, resulting in the connector disconnected state as shown in FIG. 4. Then, disconnecting the bolt 10 (FIG. 3) of the meter assembly 3 and pulling out the meter assembly 3 accomplish the dismounting of the first connector housing 2 united with the meter assembly 3, while the second connector housing 29 remains to be held by the panel wall 7.

Figure 6:
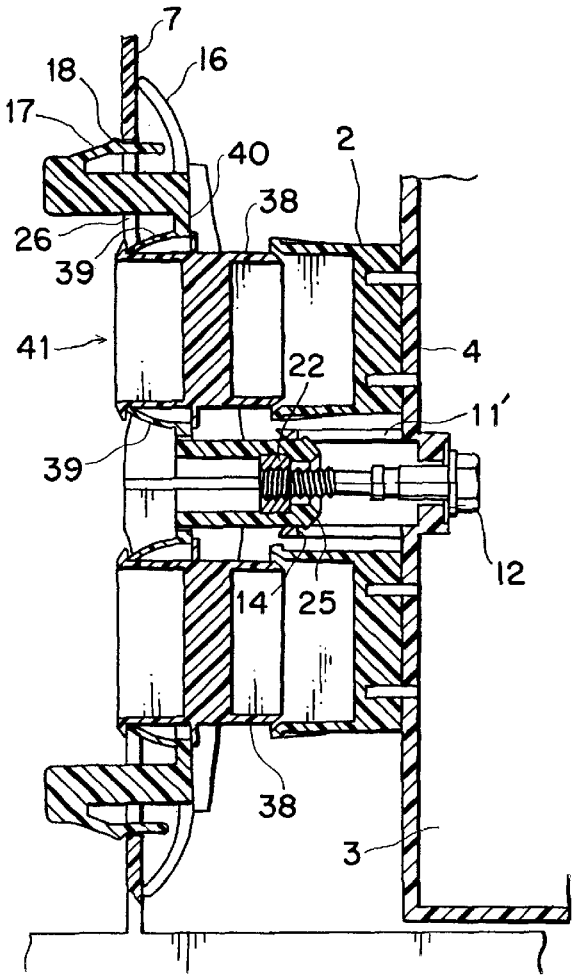
FIG. 6 is a longitudinal sectional view of a third embodiment of the connector assembly with a connector housing retaining structure according to the invention, in which the connectors have been disconnected.
Figure 7:
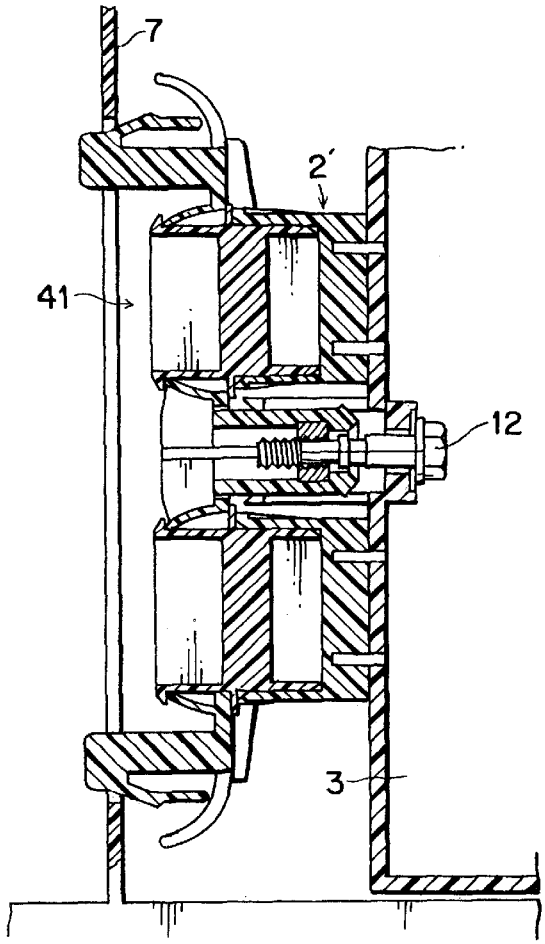
FIG. 7 is also a longitudinal sectional view of the third embodiment, in which the connectors have connected.
Figure 8:
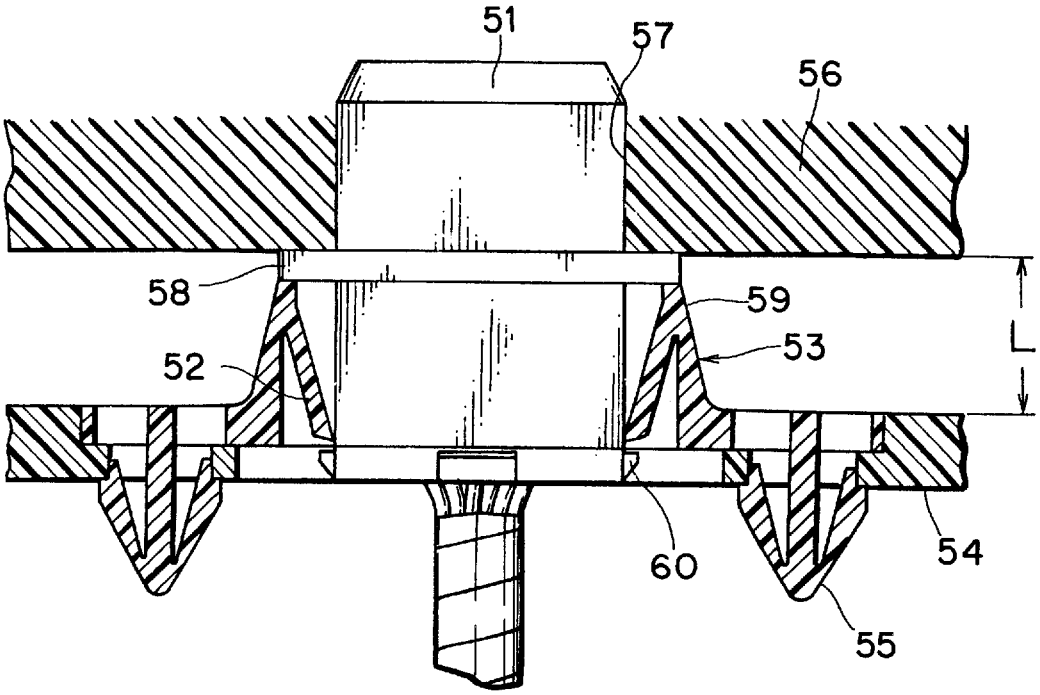
FIG. 8 PRIOR ART
FIG. 8 is a longitudinal sectional view of a conventional connector assembly with a connector housing retaining structure, in which the connectors have been connected.

FIGS. 6 and 7 show a third embodiment of the connector with a connector housing retaining structure according to the invention.

This includes a structure having been proposed in the aforementioned Japanese Patent Application No. 8-22491 filed by the same assignee of this application. In the structure, a male connector 38 is longitudinally and laterally resiliently supported by resilient arms 39 formed on four sides of a frame 40 (connector retainer members). On the other hand, the first embodiment has the male connector 5 integrally formed on the frame 15. The other structures of the third embodiment, which will not be discussed, are the same as the first embodiment. Besides, the third embodiment has a cylindrical wall 11' provided unitedly on a base plate portion 4 of the meter assembly 3. Moreover, the preliminary engaging portion 14 engaging with the preliminary stopping protrusion 25 is formed in a first connector housing 2' in the same way as the first embodiment.

In FIG. 6, the positioning protrusion 18 of the resilient retaining arm 17 provisionally engages with an end surface of the panel wall opening 26 to provisionally retain a second connector housing 41. Then, screw-joining the bolt 12 to the nut 22 as shown in FIG. 7 disengages the second connector housing 41 from the panel wall 7 to engage with the first connector housing 2'. In the state of FIG. 7, reversely turning the bolt 12, as shown in FIG. 6, engages again the second connector housing 41 to the panel wall 7. Next, detaching the bolt 10 (FIG. 3) from the meter assembly 3 and pulling out the meter assembly 3 easily disconnect the meter assembly 3 from the second connector housing 41. The second and third embodiments operate substantially with the same effects as the first embodiment.

Next, operational effects of the invention will be discussed hereinafter.

According to the invention, even with a variation of the distance between the panel wall and the electrical instrument, the screw-joining means can make the second connector housing apart from the panel wall to move it toward the first connector housing, resulting in the secure connector engagement. Further, the reverse action of the screw-joining means disconnects the connectors, and at the same time, the second connector housing has been provisionally held by the provisionally retaining means and the panel wall until the next connector engagement. Moreover, in the dismounting of the electrical instrument from the panel wall, the engaging force between the first connector housing and the second connector housing is smaller than the engaging force between the panel wall and the second connector housing. This enables to easily dismount the electrical instrument from the second connector housing, resulting in easier maintenance of the instrument.

What is claimed is:

1. A connector assembly with a connector housing retaining structure comprising:

a first connector housing to be attached to an electrical instrument and a second connector housing to be disposed toward a panel wall, wherein said first and second connector housings are connected together by a screw-joining means including a bolt and a nut;

said second connector housing can be provisionally retained on said panel wall by a provisionally retaining means;

when said connector housings connect together, said second connector housing can release from said panel wall to move toward said first connector housing; and, when said connectors separates from each other, said second connector housing can be provisionally retained on said panel wall by way of said provisionally retaining means.

2. A connector assembly as claimed in claim 1, wherein said provisionally retaining means includes a resilient retaining arm provided in said second connector housing and engaging with an opening formed in said panel wall.

3. A connector assembly as claimed in claim 1, wherein said provisionally retaining means includes a deflectable retaining arm projecting from said panel wall and a provisionally engaging portion formed in said second connector housing so as to engage with said deflectable retaining arm.

4. A connector assembly as claimed in one of claims 1 to 3, wherein said first connector housing has a preliminary engaging portion; said second connector housing has a preliminary retaining portion engaging with said preliminary engaging portion; and the stopping force between said preliminary engaging portion and said preliminary retaining portion is smaller than the engaging force between said provisionally retaining means and said panel wall.

5. A connector assembly as claimed in claim 1, wherein said second connector housing has a strut resiliently connected to the second connector housing; said provisionally retaining means includes a resilient retaining arm formed on said strut and engaging with an opening formed in said panel wall.

6. A connector assembly as claimed in claim 2, wherein said resilient retaining arm has a protrusion engaging with said opening of said panel wall in the middle of said resilient retaining arm.

7. A connector assembly as claimed in claim 3, wherein said deflectable retaining arm has a groove formed in the middle thereof and engaging with a protrusion formed on said provisionally engaging portion of said second connector housing.

* * * * *